US005163562A

United States Patent [19]

Wilhelm et al.

[11] Patent Number: 5,163,562

[45] Date of Patent: Nov. 17, 1992

[54] PROCESS FOR RECLAIMING BENTONITE AND CARBON PARTICLES FROM USED FOUNDRY SAND

[75] Inventors: Ludwig Wilhelm, Engen; Peter Rossmanith, Rielasingen, both of Fed. Rep. of Germany

[73] Assignee: Georg Fischer AG, Schaffhausen, Switzerland

[21] Appl. No.: 797,391

[22] Filed: Nov. 25, 1991

Related U.S. Application Data

[63] Continuation-in-part of Ser. No. 619,044, Nov. 28, 1990, Pat. No. 5,115,985.

[30] Foreign Application Priority Data

Nov. 23, 1990 [CH] Switzerland ..... 03723/90

[51] Int. Cl.[5] ..... B03B 9/00; B07B 9/00

[52] U.S. Cl. ..... 209/2; 209/10; 209/12; 209/144; 241/24; 241/DIG. 10; 164/5

[58] Field of Search ..... 241/14, 24, DIG. 10, 241/23; 164/5; 55/459.1; 209/2, 10, 11, 12, 138, 139.1, 144

[56] References Cited

U.S. PATENT DOCUMENTS

| | | | |
|---|---|---|---|
| 3,312,403 | 4/1967 | Zifferer | 241/24 |
| 4,354,641 | 10/1982 | Smith | 241/DIG. 10 X |
| 4,449,566 | 5/1984 | Fillpovitch et al. | 164/5 |
| 4,491,277 | 1/1985 | Bauer et al. | 241/14 X |
| 4,514,168 | 4/1985 | McMath et al. | 209/11 X |
| 4,566,637 | 1/1986 | Deoe | 241/23 |
| 4,574,045 | 3/1986 | Crossmore, Jr. | 209/11 X |
| 4,978,076 | 12/1990 | Andrews et al. | 241/DIG. 10 X |
| 5,045,090 | 3/1991 | Pohl | 241/DIG. 10 X |

FOREIGN PATENT DOCUMENTS

| | | | |
|---|---|---|---|
| 2268562 | 4/1974 | France | 209/11 |
| 1586794 | 8/1990 | U.S.S.R. | 209/12 |
| 542988 | 2/1942 | United Kingdom | 209/12 |
| 887491 | 1/1962 | United Kingdom | 209/12 |

*Primary Examiner*—Mark Rosenbaum
*Assistant Examiner*—Frances Chin
*Attorney, Agent, or Firm*—Bachman & LaPointe

[57] ABSTRACT

A process for separating bentonite and carbon carrier particles from an air-dust mixture generated from a mechanical used-sand reclamation unit and, more particularly, a process as aforesaid wherein the bentonite and carbon carrier particles are recycled to a foundry sand preparation unit.

3 Claims, 1 Drawing Sheet

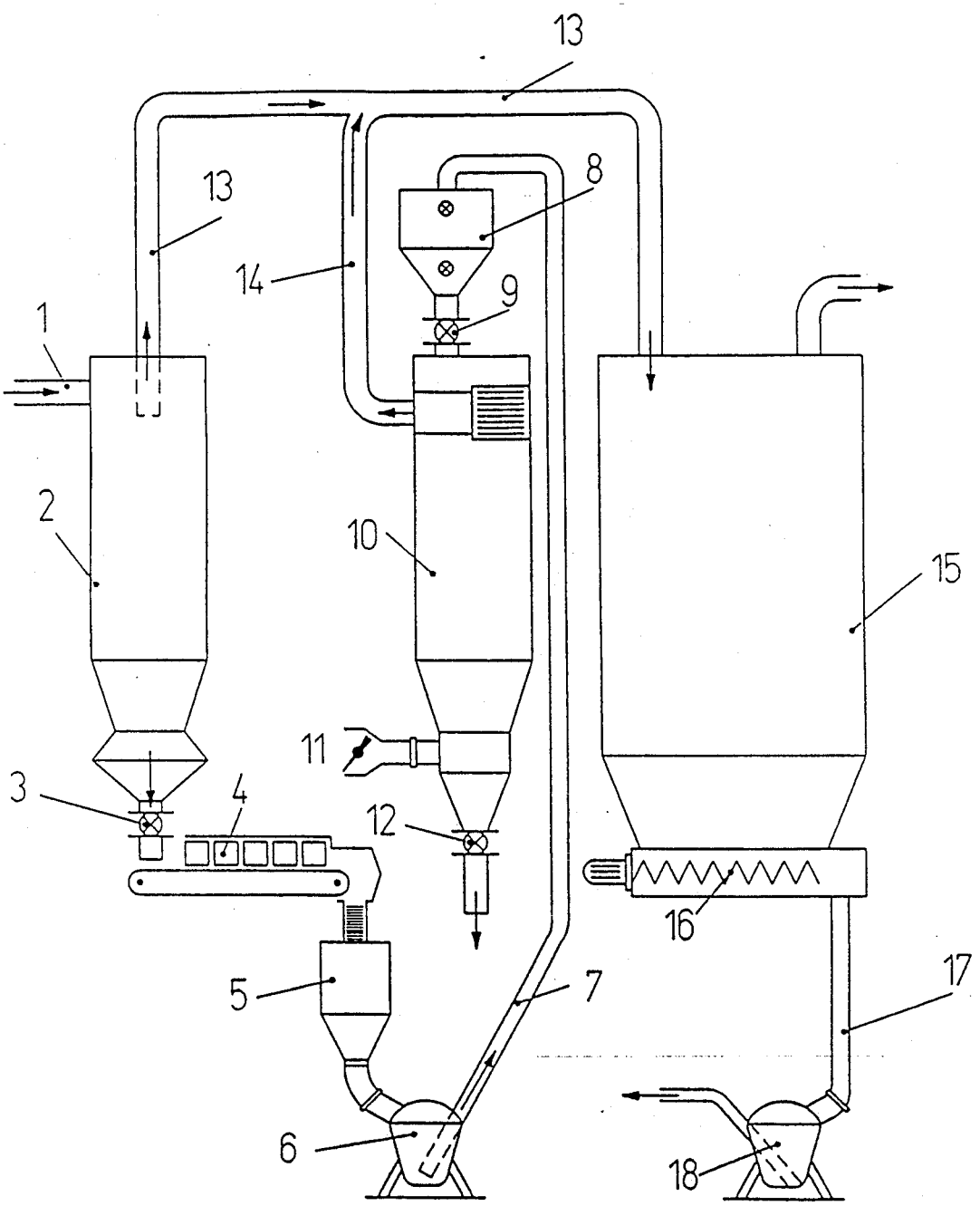
13
13
8
14
9
1
2
10
15
11
3
4
12
16
5
7
17
6
18

PROCESS FOR RECLAIMING BENTONITE AND CARBON PARTICLES FROM USED FOUNDRY SAND

CROSS-REFERENCE TO RELATED APPLICATIONS

This application is a continuation-in-part of Application Ser. No. 619,044 filed on Nov. 28, 1990 now U.S. Pat. No. 4,115,985.

BACKGROUND OF THE INVENTION

The present invention is drawn to a process for separating bentonite and carbon carrier particles from an air-dust mixture generated from a mechanical used-sand reclamation unit and, more particularly, a process as aforesaid wherein the bentonite and carbon carrier particles are recycled to a foundry sand preparation unit.

It is known in the prior art to reclaim used foundry sand by subjecting the used foundry sand to impact and shearing stresses in mechanical scouring units. See for example U.S. Pat. No. 3,312,403. During the mechanical scouring, the used sand granulars are separated from their outer shell (oolith shell) which comprises in part bentonite and carbon carrier materials. In the prior art this oolith shell is generally disposed of as unusable material. The reclaimed sand is then reused in the foundry operation operation.

The outer shell material also has value in that the bentonite and carbon carrier materials may be used again in sand preparation in the foundry. Accordingly, there have been some efforts in the prior art to separate the sand particles from the accompanying materials containing the bentonite and carbon carrier materials. These processes which employ a separation step do not result in a high recovery of the desirable bentonite and carbon carrier materials.

Naturally, it would be highly desirable to provide a process for treating the air dust mixture generated from mechanical used-sand reclamation units wherein a high degree of the usable bentonite and carbon carrier materials may be separated and recycled for foundry sand preparation.

Accordingly, it is the principle object of the present invention to provide an effect process for separating bentonite and carbon carrier particles from an air-dust mixture qenerated from a mechanical used-sand reclamation unit wherein a large portion of the desired bentonite and carbon carrier particles are separated for recycle to the foundry sand preparation unit.

SUMMARY OF THE INVENTION

The foregoing object is achieved by way of the present invention wherein the air-dust mixture generated from the mechanical used-sand reclamation unit is fed to a separator for separating the air-dust mixture into a first stream of fine usable dust comprising bentonite and carbon carrier particles and unusable dust. The unusable dust is thereafter passed from the separator to a dryer for removing water from the unusable dust so as to form a dried dust product. The dried dust product is thereafter fed to a sifter wherein the dried dust product is further separated into a second stream of fine usable dust comprising bentonite and carbon carrier particles and an unusable quartz comprising dust. The first and second streams of fine usable dust are thereafter recycled to a foundry sand preparation unit for use therein.

BRIEF DESCRIPTION OF THE DRAWINGS

The figure is a schematic illustration of the process in accordance with the present invention.

DETAILED DESCRIPTION

The process of the present invention will be described with reference to the figure.

An air-dust mixture from a mechanical used-sand reclamation unit is delivered via pipeline 1 to a cyclone separator 2. In the cyclone separator 2 the air-dust mixture is separated into unusable dust and a first stream of fine usable dust comprising bentonite and carbon carrier particles. The first stream of fine usable dust is taken off from the separator 2 and delivered via conduit 13 through a filter unit 15. The unusable dust, which represents more than 90% of the dust delivered to the separator tube is delivered from the separator tube via a bucket wheel sluice 3 to a belt of a continuous flow dryer 4.

The unusable dust is dried by dryer 4 so as to reduce the water content of the dust to about not more than 1% $H_2O$. The dried dust is thereafter carried from the dryer 4 via a container 5, a pneumatic conveyor 6 and a pipeline 7 to a storage container 8. The dried dust in the storage container 8 is thereafter conveyed via bucket wheel sluice 9 to a sifter unit 10 for further separation. The dried dust in sifter unit 10 is contacted with a controlled amount of air supplied to the sifter 10 through control flap 11 for separating fine dust particles of bentonite and carbon from the remaining dust particles comprising in a large amount quartz. The fine dust particles of bentonite and carbon are thereafter removed from the sifter unit 10 in a second stream of fine usable dust via conduit 14 and delivered along with the first stream of fine usable dust from cyclone 2 to the filter unit 15 via conduit 13. The remaining unusable quartz comprising dust from the sifter 10, which is of little value from the point of view of foundry use, is removed from the sifter 10 by bucket wheel sluice 12 and disposed of.

The usable dust comprising bentonite and carbon carrier particles is filtered in filter unit 15 and the bentonite and carbon particles are discharged to screw feeder 16, pipeline 17 and conveyor 18 for recycling of the bentonite and carbon carrier particles to the foundry sand preparation unit.

In accordance with a preferred embodiment of the present invention, the dryer 4 is preferably a microwave continuous flow dryer which is capable of evaporating water in the whole volume of the dust layer to the desired water content of not more than 1% $H_2O$. By employing a microwave dryer as aforesaid the process can be carried out without the need of a cyclonic fluidized bed thus minimizing the amount of air needed for the process.

In accordance with the process of the present invention, the process has the advantage that the bonding clays and carbon particles may be concentrated at usable levels which allow for the recycle of the material to the foundry sand preparation unit. A further advantage of the process of the present invention is that the residual unusable material comprised chiefly of quartz dust is greatly reduced and the carbon content of the unusable material is greatly reduced which allows for the disposal of the unusable material without negative affects on the environment.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

We claim:

1. A process for separating bentonite and carbon carrier particles from an air-dust mixture generated from a mechanical used-sand reclamation unit comprising: feeding said air-dust mixture to a separator and separating said air-dust mixture in said separator into (1) a first stream of fine usable dust comprising bentonite and carbon carrier particles and (2) unusable dust; removing said unusable dust from said separator and passing said unusable dust to a dryer for removing water therefrom so as to form a dried dust product; feeding said dried dust to a sifter; separating said dried dust in said sifter into a second stream of fine usable dust comprising bentonite and carbon carrier particles and unusable quartz comprising dust; and recycling said first stream and said second stream to a foundry sand preparation unit.

2. A process according to claim 1 wherein the first stream is transported from said separator to a filtering unit prior to recycling.

3. A process according to claim 1 wherein the drying of the unusable dust is carried out by means of microwave energy.

* * * * *